US008745898B2

(12) United States Patent
Stewart

(10) Patent No.: US 8,745,898 B2
(45) **Date of Patent: *Jun. 10, 2014**

(54) SKATE BOOT WITH IMPROVED FLEXIBILITY

(71) Applicant: Sport Maska Inc., Montreal (CA)

(72) Inventor: Andrew Stewart, Pointe-Claire (CA)

(73) Assignee: Sport Maska Inc., Montreal, Quebec ( * ) Notice: Subject to any disclaimer, the term of this patent is extended or adjusted under 35 U.S.C. 154(b) by 0 days.

This patent is subject to a terminal disclaimer.

(21) Appl. No.: 13/934,937

(22) Filed: Jul. 3, 2013

(65) Prior Publication Data

US 2013/0291318 A1 Nov. 7, 2013

Related U.S. Application Data

(63) Continuation of application No. 12/522,718, filed as application No. PCT/CA2008/000059 on Jan. 11, 2008, now Pat. No. 8,505,217.

(60) Provisional application No. 60/880,049, filed on Jan. 12, 2007.

(51) Int. Cl.
*A43B 5/00* (2006.01)

(52) U.S. Cl.
USPC ..... 36/88; 36/115

(58) Field of Classification Search
USPC ..... 36/88, 89, 105, 115
See application file for complete search history.

(56) References Cited

U.S. PATENT DOCUMENTS

| | | | |
|---|---|---|---|
| 2,261,453 | A | 11/1941 | Reinhart et al. |
| 2,362,824 | A | 11/1944 | Hueston |
| 2,617,207 | A | 11/1952 | Jennett |
| 2,789,374 | A | 4/1957 | Planert |
| 4,126,323 | A | 11/1978 | Scherz |
| 4,384,413 | A | 5/1983 | Bourque |
| 5,069,462 | A | 12/1991 | Murga |
| 5,072,529 | A | 12/1991 | Graf |
| 5,331,752 | A | 7/1994 | Johnson et al. |
| 5,435,579 | A | 7/1995 | Pozzobon |
| 5,498,033 | A | 3/1996 | Hoshizaki et al. |
| 5,582,417 | A | 12/1996 | Schaper et al. |
| 5,752,707 | A | 5/1998 | Peck et al. |
| 5,755,449 | A | 5/1998 | Pozzobon |
| 5,947,487 | A | 9/1999 | Keleny et al. |
| 5,966,843 | A | 10/1999 | Sand et al. |

(Continued)

FOREIGN PATENT DOCUMENTS

| | | |
|---|---|---|
| CA | 1097062 | 3/1981 |
| CA | 1143149 | 3/1983 |
| CA | 1266174 | 2/1990 |
| CA | 2427965 | 11/2003 |

*Primary Examiner* — Marie Patterson

(74) *Attorney, Agent, or Firm* — Norton Rose Fulbright Canada

(57) ABSTRACT

A method of making a skate boot including manufacturing a rear element including a tendon guard for covering at least a rear portion of the ankle received within the boot, and forming a direct connection at a fixed position between contacting portions of the rear element and of a remainder of the skate boot separately from the quarters, the direct connection being formed such that the rear element is an external element of the boot and such that an upper portion of the rear element is displaceable relative to the quarters in a forward and rearward direction, the upper portion of the rear element being displaceable through flexing of the rear element about the connection.

19 Claims, 2 Drawing Sheets

(56) References Cited

U.S. PATENT DOCUMENTS

| | | | | |
|---|---|---|---|---|
| 6,018,892 | A | 2/2000 | Acheson et al. | |
| 6,082,745 | A | 7/2000 | Pellegrini, Jr. et al. | |
| 6,098,314 | A | 8/2000 | Pozzobon | |
| 6,212,796 | B1 | 4/2001 | Kubelka | |
| 6,260,290 | B1 | 7/2001 | Chenevert | |
| 6,340,164 | B1 | 1/2002 | Borel | |
| 6,367,818 | B2 | 4/2002 | Meibock et al. | |
| 6,381,877 | B2 | 5/2002 | Filice | |
| 6,499,233 | B1 | 12/2002 | Chenevert | |
| 6,550,159 | B1 | 4/2003 | Madore | |
| 6,749,203 | B2 | 6/2004 | Meibock et al. | |
| 6,772,540 | B2 | 8/2004 | Delgorgue et al. | |
| 6,871,424 | B2 | 3/2005 | Labonte et al. | |
| 7,028,421 | B2 | 4/2006 | Galeyev | |
| D578,595 | S | 10/2008 | Howard et al. | |
| D579,193 | S | 10/2008 | Howard et al. | |
| D579,510 | S | 10/2008 | Howard et al. | |
| 8,505,217 | B2 * | 8/2013 | Stewart | 36/88 |
| 2003/0102641 | A1 | 6/2003 | Liu | |
| 2003/0204971 | A1 | 11/2003 | Fauver | |
| 2005/0229436 | A1 | 10/2005 | Bock | |
| 2006/0179686 | A1 | 8/2006 | Labonte | |

* cited by examiner

SKATE BOOT WITH IMPROVED FLEXIBILITY

CROSS-REFERENCE TO RELATED APPLICATIONS

The present application is a continuation of U.S. application Ser. No. 12/522,718, which was filed on Apr. 9, 2010 as a national phase entry of PCT/CA2008/000059 filed on Jan. 11, 2008, which claims priority on U.S. provisional application No. 60/880,049 filed on Jan. 12, 2007, the entire contents of all of which are incorporated by reference herein.

TECHNICAL FIELD

The present invention relates to skates, such as ice skates or in-line roller skate for example, and more particularly to the boots of such skates.

BACKGROUND OF THE ART

Skate boots, and in particular ice hockey skate boots, have generally become more and more rigid through time in order to provide the necessary support for the players. Skate boots must usually provide at least some ankle support, while nevertheless allowing a certain degree of flexion to accommodate the dorsiflexion and plantar flexion of the ankle joint.

Usually, a brand new skate boot is too rigid for many player's tastes, until such time as the wearer has succeeded in "breaking it in". After the break-in period, the boot is considered at an adequate flexibility level. As the skate becomes more broken down through extended use, creasing usually appears on the boot, for example in the quarter portions of the boot in proximity of the eyelets. As this creasing in the boot material increases, the boot becomes more and more flexible, to a point when the boot is too flexible to provide proper support for the wearer. As such, a skate boot generally has an adequate level of flexibility for a period which will vary depending on the personal likes and style of the wearer, but which will generally represent only a portion of the total possible lifespan of the boot.

Accordingly, improvements are desirable.

SUMMARY

In one aspect, there is provided a method of making a skate boot comprising: manufacturing two quarters; manufacturing a rear element including a tendon guard for covering at least a rear portion of the ankle received within the boot; manufacturing a remainder of the skate boot and connecting the quarters to the remainder of the skate boot such that each of the quarters extends on a respective side of the boot; and forming a direct connection at a fixed position between contacting portions of the rear element and of the remainder of the skate boot, the direct connection being formed such that the rear element is an external element of the boot and such that an upper portion of the rear element is displaceable relative to the quarters in a forward and rearward direction, the upper portion of the rear element being displaceable through flexing of the rear element about the connection.

In a further aspect, there is provided a method of making a skate boot comprising: manufacturing an upper including a quarter on either side thereof; manufacturing a rear element including a tendon guard for covering at least a rear portion of the ankle received within the boot; and forming a direct connection between a bottom portion of the rear element and a part of the skate boot outside of the quarters and separately from the quarters such that the bottom portion remains at a fixed position with respect to the quarters, the rear element is an external element of the boot, and an upper portion of the rear element is displaceable relative to the quarters in a forward and rearward direction following a given forward and rearward flexion of the ankle without causing creasing of the upper of the skate boot, the upper portion of the rear element being displaceable through flexing of the rear element.

DESCRIPTION OF THE DRAWINGS

Reference will now be made to the accompanying drawings, showing by way of illustration particular embodiments of the present invention and in which.

DETAILED DESCRIPTION

Figure 1:
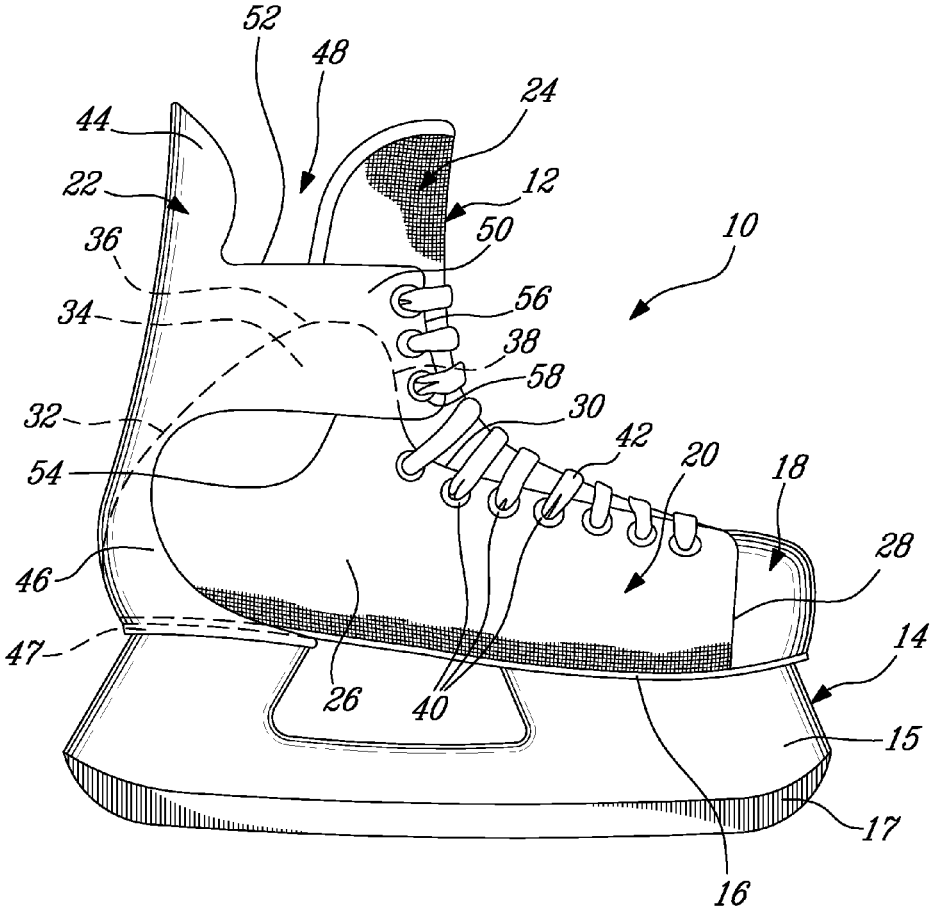
FIG. 1 is a schematic side view of a skate in accordance with a particular embodiment of the present invention.

Referring now to FIG. 1, a skate according to a particular embodiment of the present invention is generally shown at 10. The skate 10 includes a boot 12, to which is attached a blade assembly 14. The blade assembly include a plastic blade holder portion 15 fixed to the bottom of the outsole 16, and a metal blade 17 retained within the holder. Although the skate 10 is depicted as a hockey ice skate, the present invention could equally apply to other types of skates, such as for example a roller hockey skate, a recreational ice skate or a recreational in-line roller skate.

The skate boot 12 generally comprises an outsole 16 defining the bottom portion of the boot, to which are connected a toe cap 18 surrounding the toes, two quarters 20 (only one of which is shown, given that only one side of the skate is visible) covering the sides of the foot, and a rear element 22 covering a rear portion of the foot. A tongue 24 extends from the toe cap 18 to cover the instep.

Each quarter 20 includes a bottom section 26 extending from a respective side of the outsole 16. The bottom section 26 has a substantially triangular shape, a truncated apex of which defining a front edge 28 connected to the toe cap 18. The bottom section 26 also defines a tongue edge 30 extending from the front edge 28 in an upwardly angled manner, and a rear edge 32 extending from the outsole 16 adjacent the rear of the heel in a frontwardly angled manner.

Each quarter 20 also includes a substantially smaller top section 34 having a rounded triangular shape and extending upwardly from the bottom section 26. The top section 34 covers the side of the ankle and includes a rear edge 36 continuous with the rear edge 32 of the bottom section 26, and a tongue edge 38 intersecting the tongue edge 30 of the bottom section 26 at an obtuse angle therewith. The quarters 20 thus partially wrap the ankle for improved support thereof. The tongue edges 30, 38 of both the bottom and top sections 26, 34 overlap the tongue 24.

Each bottom section 26 includes a series of eyelets 40 defined therethrough in proximity of the tongue edge 30, such that the quarters 20 are interconnected by a lace 42 extending through the eyelets 40 and over the tongue 24.

The quarters 20 are made of any type of material adequate for a skate boot, including but not limited to nylon, adequate types of copolymers such as Surlyn® (poly(ethylene-co-methacrylic acid) or EMAA), expanded polypropylene (EPP), polyurethane (PU), other appropriate thermoformable plastics, or leather.

Although not shown, the quarters 20 optionally include a portion covering and protecting the Achilles tendon, which interconnects the two quarters 20 at the rear of the foot. This portion is made of a material flexible enough to follow the motions of the ankle, which may or may not be similar to the material of the remainder of the quarters.

The rear element 22 includes an elongated tendon guard 44 having a base portion which includes an enlarged, substantially triangular bottom portion 46 integral with a horizontal portion 47 connected to the outsole 16 around the heel and frontwardly thereof. Preferably, the horizontal portion 47 of the base of the rear element 22 is disposed beneath the heel of the outsole 16, more particularly between the skate blade holder 15 and the outsole 16. The horizontal portion 47 is thereby securely fastened to both the skate blade holder 15 and the heel portion of the outsole 16, providing an anchor point for the flexing/pivoting fore-aft movement of the tendon guard 44 of the rear element relative to the rest of the boot upper. This connection may be made with the use of fasteners such as rivets, threaded fasteners (screws, etc.) or an adequate type of adhesive. Alternately, in one particular embodiment, the rear element 22 is an integral part of the outsole 16, thus playing the role of the horizontal portion 47, and as such the outsole 16 and tendon guard 44 are integrally manufactured of a common material, for example through molding. The toe cap 18 can also be made an integral part of the outsole 16 together with the rear element 22. The tendon guard 44 is thus "L-shaped" and extends up to, and beyond, a height substantially corresponding to a height of the tongue 24. An opening 48 is thus defined between the tendon guard 44, the quarters 20 and the tongue 24 for inserting the foot within the boot 12. The orientation of the horizontal portion 47 also defines a rake angle with the upwardly extending elongated tendon guard.

The rear element 22 also includes two substantially rectangular lateral strap sections 50 (only one of which is shown, given that only one side of the skate is visible) extending from the tendon guard 44 around each side of the ankle and toward the front thereof. Each lateral strap section 50 overlaps the ankle bone and defines a top edge 52 bordering the opening 48 of the boot 12, a bottom edge 54 overlapping the respective quarter 20, and a front edge 56 extending frontwardly of the top section 34 of the respective quarter 20 and overlapping the tongue 24. As such, each top section 34 of the quarter 20 is entirely covered by the respective lateral strap section 50 of the rear element 22. The portion of the tendon guard 44 extending under the lateral sections 50 also partially overlaps the quarters 20, such as to completely cover the rear of the foot.

Each lateral strap section 50 includes, in proximity of the front edge 56, a series of eyelets 58 defined therethrough. As such, the lace 42 interconnecting the quarters 20 also interconnects the lateral sections 50 through the eyelets 58 and over the tongue 24.

The base of the rear element 22 is substantially fixed (or is integrally formed with) to the outsole 16 at a rear heel portion thereof, but is otherwise substantially free of interconnection with the rest of the boot. Accordingly, the rear element, external to the rest of the boot upper, is able to pivot or flex about a base thereof, in a forward and rearward direction. The rear element 22 thus acts like a lever arm, flexing forward about its connection to the outsole 16 during dorsiflexion, due to the ankle pulling on the lateral strap sections 50 through the lace 42 interconnecting the lateral sections 50 and extending in front of the ankle. The rear element 22 also flexes backward about its connection to the outsole 16 during plantar flexion, when the pull of the ankle on the lateral sections 50 is released and force is applied by the wearer on the rear tendon guard 44. The rear element 22 further flexes at least slightly following the side-to-side flexion of the ankle. The thickness and material of the rear element 22 is thus selected such as to allow a desired degree of flexion of the tendon guard 44 following the flexion motions of the ankle. In a particular embodiment, the rear element 22 is made of carbon fiber or fiberglass composites. In an alternative embodiment, the rear element 22 is made of appropriate injected or thermoformed materials. As such, the rear element 22 facilitates the flexion of the ankle, while the overlapping rear element 22 and quarters 20 provide adequate lateral ankle support for the user. By changing the thickness and/or material used for the rear element 22, the degree of flexion provided by the skate boot 12 can thus be tuned to the particular needs of a player.

The rear element 22 is also provided with appropriate padding (not shown) on its internal surfaces and other sections thereof coming into contact with the foot or ankle of the wearer, such as for example along the top edge 52 of the lateral sections 50.

Figure 2:
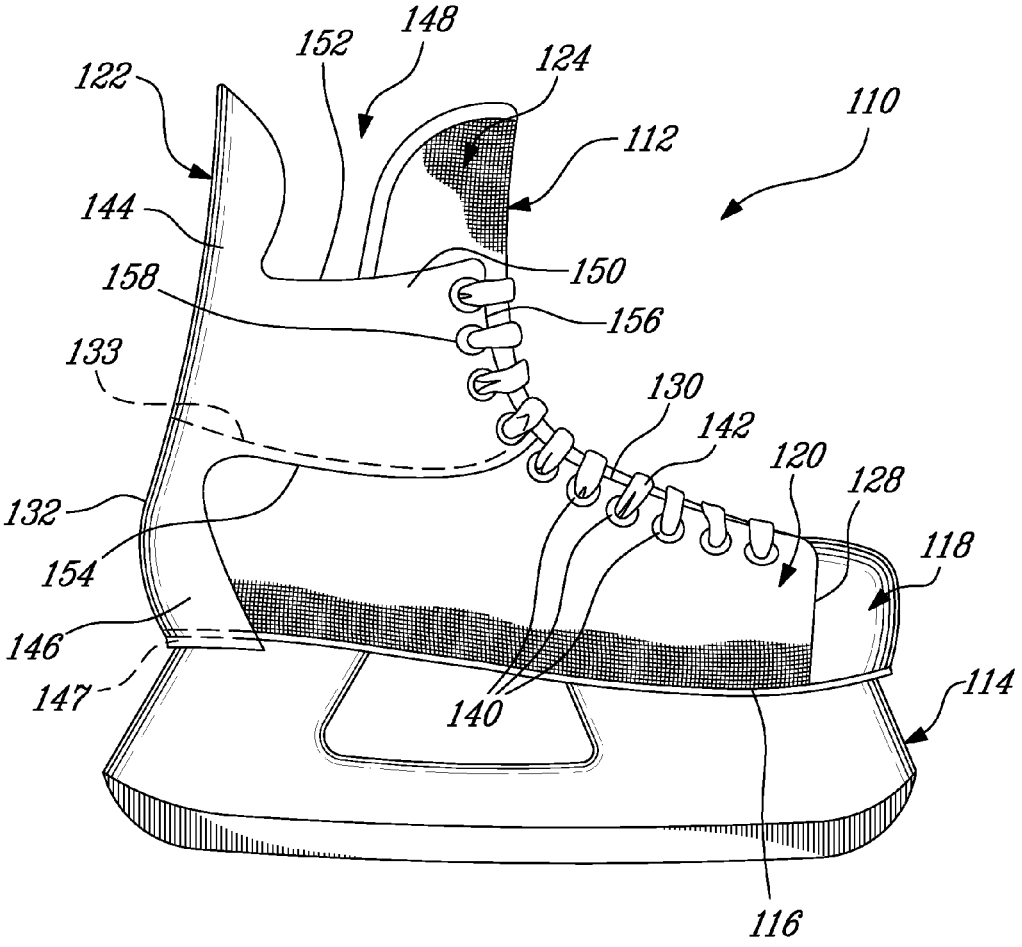
FIG. 2 is a schematic side view of a skate in accordance with an alternate embodiment of the present invention.

Referring to FIG. 2, a skate 110 according to an alternate embodiment of the present invention is shown. The skate 110 is also depicted as a hockey ice skate, with a boot 112 and a blade assembly 114 connected thereto. However, as in the previous embodiment, the skate 110 can alternately be a recreational ice skate or include another type of assembly connected to the boot 112, such as for example an in-line roller assembly to obtain a recreational or hockey roller skate.

As in the previous embodiment, the skate boot 112 generally comprises a tongue 124 and an outsole 116 to which are connected a toe cap 118, two quarters 120 (only one of which is shown, given that only one side of the skate is visible) and a rear element 122.

Each quarter 120 extends from a respective side of the outsole 116 and includes a front edge 128 connected to the toe cap 118, a tongue edge 130 extending from the front edge 128 in an upwardly angled manner, a substantially vertical rear edge 132 extending from the outsole 116 at the heel, and a substantially horizontal curved top edge 133 extending between the tongue edge 130 and the rear edge 132. The top edge 133 extends under the perimeter of the bottom of the ankle, such that the ankle is not covered by the quarter 120. The tongue edge 130 overlaps the tongue 124.

As in the previous embodiment, each quarter 120 includes eyelets 140 defined therethrough adjacent the tongue edge 130, and the quarters 120 are interconnected by a lace 142 extending through the eyelets 140 and over the tongue 124.

The rear element 122 includes an elongated tendon guard 144 having an enlarged, substantially triangular bottom portion 146 integral with a horizontal portion 147 which is connected to the outsole 116 around the heel, for example through rivets or adhesive. The horizontal portion 147 forms a rake angle with the upwardly extending portion of the elongated tendon guard. Preferably, the horizontal portion 147 of the base of the rear element 122 is disposed beneath the heel of the outsole 116, more particularly between the skate blade holder 115 and the outsole 116. The horizontal portion 147 is thereby securely fastened to both the skate blade holder 115 and the heel portion of the outsole 116, providing an anchor point for the flexing/pivoting fore-aft movement of the tendon guard 44 of the rear element relative to the rest of the boot upper. Although the horizontal portion 147 extends forwardly only a portion of the distance of the rear support portion of the skate blade holder 15, as shown in FIG. 2, it is to be understood that the horizontal portion can also cover a larger area of the outsole heel, such as in the embodiment of FIG. 1 for example, wherein the horizontal portion 47 extends forward from the hell the full length of the skate blade holder's rear support. Alternately, in another embodiment, the outsole 116 is an integral part of the rear element 122, the outsole 116 and rear element 122 being integrally formed during manufacturing of a single piece. As such, the rear element 122 is able to flex, or pivot, relative to the outsole 116, about their interconnection point at the base of the heel.

The tendon guard 144 extends up to a height substantially corresponding to, or exceeding, a height of the tongue 124, with the opening 148 of the boot 112 being defined between the tongue 124, the quarters 120, and the tendon guard 144. The rear element 122 also includes two substantially rectangular lateral strap sections 150 (only one of which is shown, given that only one side of the skate is visible) which are integrally formed therewith and extend from the tendon guard 144 around the ankle and toward the front thereof. Each lateral section 150 covers the ankle bone and includes a top edge 152 bordering the opening 148 of the boot 112, a bottom edge 154 extending under the top edge 133 of the respective quarter 120, and a front edge 156 continuous with the tongue edge 130 of the respective quarter 120 and overlapping the tongue 124. The lateral sections 150 thus extend lower than the lateral sections 50 of the previous embodiment, such as to partially overlap the lower quarters 120. The portion of the tendon guard 144 extending down from lateral sections 150 also partially overlaps the quarters 120, such as to completely cover the rear of the foot.

Each lateral section 150 includes eyelets 158 defined therethrough in proximity of the front edge 156, and the lateral sections 150, like the quarters 120, are interconnected by the lace 142 extending through the eyelets 158 and over the tongue 124.

As in the previous embodiment, the rear element 122 is made of a material having a flexibility selected according to the needs of the user. However, in this embodiment the ankle is not surrounded by the quarters 120 but rather only by the rear element 122, and as such this embodiment provides improved lateral flexibility at the ankle while still providing adequate support.

In both embodiments, as the rear element 22, 122 and the quarters 20, 120 are separate elements (i.e. are not directly connected together), flexion of the rear element 22, 122 does not create the creasing in the quarters 20, 120 usually seen in skate boots where the rear element and quarters are interconnected, such as for example in boots where the upper is made in a single piece. As such the level of flexibility of the skate boot 12, 112 remains substantially constant throughout the lifespan of the boot, eliminating the break-in period necessary in some prior art skate boots before the boot can reach a desired flexibility, as well as the final period of excessive flexibility brought by the creasing in the quarters caused in some prior art boots. As such, the useful life of the skate boot 12, 112 is maximized.

As the rear element 22, 122 defines part of an outer surface of the boot 12, 112, i.e. it is an external component of the skate boot 12, 112 (ex: external to the quarters 20,120, etc., and the other portions of the boot upper), the rear element 22, 122 can easily be removed and substituted, when the rear element 22, 122 is connected to the outsole 16, 116 through removable fasteners such as rivets, threaded fasteners, etc. For example, the rear element 22, 122 can be substituted for a rear element having a different level of flexibility. Clearly, in the embodiment where the rear element 22, 122 is integrally formed with the outer sole 16, 116, the rear element portion is not so readily interchangeable, however the entire sole and rear element assembly can be removed and interchanged, if desired.

In an alternate embodiment which is not shown, the interconnected outsole 16, 116, rear element 22, 122 and toe cap 18, 118, whether integrally made from a single piece or made separately and later interconnected, are provided together with the blade assembly 14, 114 but without the rest of the boot 12, 112, such as to define a strap-on skate to be attached over a regular boot or shoe or over an independent skate boot.

In a particular embodiment, the material selected for the rear element 22, 122, for example the carbon fiber or fiberglass composite, advantageously provides slashing or puck impact protection for the back of the foot.

Typically, the rake angle of a prior art skate boot, i.e. the angle between the outsole and the rear portion of the skate extending therefrom, is fixed. In the skate boot 12, 112, as the rear element 22, 122 is independent from the quarters 20, 120, the rake angle of the skate boot 12, 112 can be customized according to a user's preference simply by changing the inclination of the tendon guard 44, 144 with respect to the horizontal portion 47, 147 of the rear element 22, 122 or, in the case where the rear element 22, 122 and the outsole 16, 116 are integrally manufactured, the inclination of the tendon guard 44, 144 with respect to the outsole 16, 116. As such the rake angle can be easily customized with minimal changes to the skate boot 12, 112 (e.g. without changes to the quarters 20, 120), and thus at minimal costs.

As noted above, the rear element 22, 122 can be integrally formed with the outsole 16, 116. In this case, the horizontal portion 47, 147 of the rear element 22, 122 is therefore integrally formed with the outsole. While integral with the outsole, the horizontal portions can be as shown in FIGS. 1 and 2, i.e. being disposed beneath a heel portion of the outsole (to which it is integrally formed in this embodiment), or alternatively the horizontal portions 47, 147 can simply been one with the rear heel portion of the outsole 16, 116. In other words, rather than the horizontal portions 47, 147 being disposed lower than outsole, they simply form part of the outsole itself and are therefore disposed at the same vertical elevation as the remainder of the outsole.

The height cut of the boot 12, 112 can also be easily customized by changing the height of the lateral sections 50, 150 according to the user's preference, selecting between added supports provided by a higher boot and increased flexibility provided by a lower boot.

The embodiments of the invention described above are intended to be exemplary. Those skilled in the art will therefore appreciate that the foregoing description is illustrative only, and that various alternate configurations and modifications can be devised without departing from the spirit of the present invention.

For example, the boot configuration of the present invention could be applied to types of boots other than skate boots, such as for example ski boots.

The invention claimed is:

1. A method of making a skate boot comprising:

manufacturing two quarters;

manufacturing a rear element including a tendon guard for covering at least a rear portion of the ankle received within the boot;

manufacturing a remainder of the skate boot and connecting the quarters to the remainder of the skate boot such that each of the quarters extends on a respective side of the boot; and forming a direct connection at a fixed position between contacting portions of the rear element and of the remainder of the skate boot, the direct connection being formed such that the rear element is an external element of the boot and such that an upper portion of the rear element is displaceable relative to the quarters in a forward and rearward direction, the upper portion of the rear element being displaceable through flexing of the rear element about the connection.

2. The method according to claim 1, wherein manufacturing the remainder of the skate boot includes providing an outsole, and wherein forming the direct connection includes directly connecting a base of the rear element to a heel portion of the outsole.

3. The method according to claim 2, wherein the base is connected to an underside of the outsole.

4. The method according to claim 3, further comprising attaching a blade holder to the outsole and to the base of the rear element such that the base of the rear element is received between the outsole and the blade holder.

5. The method according to claim 1, wherein the direct connection is formed using adhesive, fasteners, or a combination thereof.

6. The method according to claim 1, wherein manufacturing the remainder of the skate boot includes providing an outsole, and wherein forming the direct connection includes integrally forming the rear element with the outsole.

7. The method according to claim 1, wherein the direct fixed connection is formed to be detachable.

8. The method according to claim 1, wherein manufacturing the quarters is performed using a first material, and manufacturing the rear element is performed using a second material different from the first material.

9. The method according to claim 1, wherein manufacturing the rear element is performed using a material selected from the group consisting of carbon fiber, fibreglass, plastic, and combinations thereof.

10. The method according to claim 1, further comprising overlapping each quarter with a respective laterally extending section of the rear element without connecting the respective section of the rear element to the quarter.

11. The method according to claim 1, wherein manufacturing the rear element includes forming a base extending forwardly and angled with respect to the tendon guard, the direct connection being defined at the base.

12. The method according to claim 11, wherein the direct connection is defined along an underside of an element of the remainder of the skate boot.

13. A method of making a skate boot comprising:

manufacturing an upper including a quarter on either side thereof;

manufacturing a rear element including a tendon guard for covering at least a rear portion of the ankle received within the boot; and forming a direct connection between a bottom portion of the rear element and a part of the skate boot outside of the quarters and separately from the quarters such that the bottom portion remains at a fixed position with respect to the quarters, the rear element is an external element of the boot, and an upper portion of the rear element is displaceable relative to the quarters in a forward and rearward direction following a given forward and rearward flexion of the ankle without causing creasing of the upper of the skate boot, the upper portion of the rear element being displaceable through flexing of the rear element.

14. The method according to claim 13, further comprising providing an outsole and wherein the step of forming the direct connection further comprises fastening only the bottom portion of the rear element to a heel portion of the outsole, a remainder of the rear element being displaceable relative to the upper.

15. The method according to claim 13, wherein the step of forming the direct connection further comprises using adhesive, fasteners, or a combination thereof.

16. The method according to claim 13, wherein the step of forming the direct connection comprises integrally forming the rear element with an outsole of the skate boot.

17. The method according to claim 13, wherein the step of forming the direct connection comprises detachably engaging the rear element to the part of the skate boot.

18. The method according to claim 13, further comprising manufacturing the quarters of a first material and the rear element of a second material different from the first material.

19. The method according to claim 13, wherein the step of manufacturing the rear element includes forming the rear element out of a material selected from the group consisting of carbon fiber, fibreglass, plastic, and combinations thereof.

* * * * *